United States Patent [19]

Ortiz Burgos

[11] Patent Number: 4,489,946

[45] Date of Patent: Dec. 25, 1984

[54] BOARD GAME HAVING CONSISTENT SHAPE RELATIONSHIP AMONG ITS PARTS

[76] Inventor: Angel A. Ortiz Burgos, A-2-11 Sequoya St., Park Gardens, Rio Piedras, P.R. 00926

[21] Appl. No.: 428,487

[22] Filed: Sep. 30, 1982

[51] Int. Cl.[3] ..... A63F 3/00

[52] U.S. Cl. ..... 273/249; 273/285; 273/145 A

[58] Field of Search ..... 273/285, 243, 249, 250, 273/251, 146, 145 A, 145 R, 286, 248, 252–254, 287

[56] References Cited

U.S. PATENT DOCUMENTS

| | | | |
|---|---|---|---|
| 733,793 | 7/1903 | Arriaga | 273/243 |
| 1,523,615 | 1/1925 | Stern | 273/146 |
| 4,252,324 | 2/1981 | Simons | 273/286 |
| 4,262,907 | 4/1981 | Ginsberg et al. | 273/249 |

FOREIGN PATENT DOCUMENTS

| | | | |
|---|---|---|---|
| 2838478 | 5/1980 | Fed. Rep. of Germany | 273/146 |
| 1500257 | 9/1967 | France | 273/243 |

*Primary Examiner*—Richard C. Pinkham
*Assistant Examiner*—Matthew L. Schneider
*Attorney, Agent, or Firm*—William F. Frank

[57] ABSTRACT

The board game consists of a central, geometrically shaped goal area with rectangular playing surfaces extending from each side of the goal area. A single tortuous path extends outwardly from the center along each of the rectangular playing surfaces. The shapes of the spaces that comprise the tortuous path are identical to the shape of the goal area. The game also utilizes multi-sided dice having faces which correspond in shape to the shape of the goal area. The playing pieces used in the game are similarly shaped. The game board is hingedly constructed so that when not in use, it can be folded into a three-dimensional box that is then used to store the playing pieces and dice. The game also includes a cover for the folded box. The cover is used during the play of the game to shake and roll the dice.

10 Claims, 24 Drawing Figures

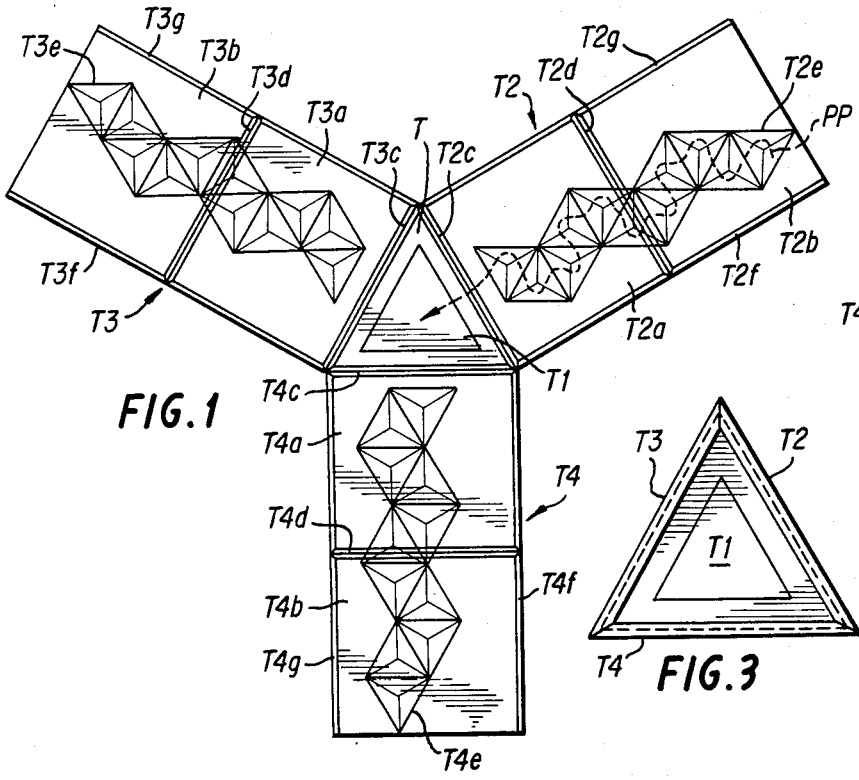
FIG. 1
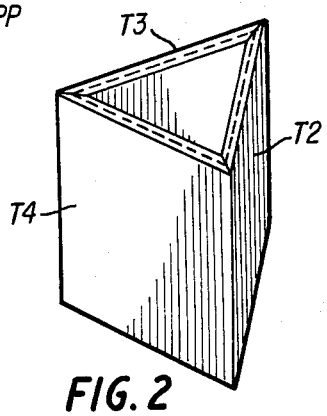
FIG. 2
FIG. 3
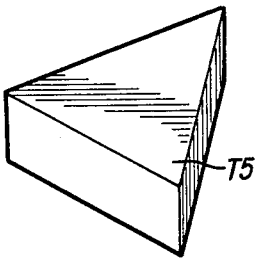
FIG. 4
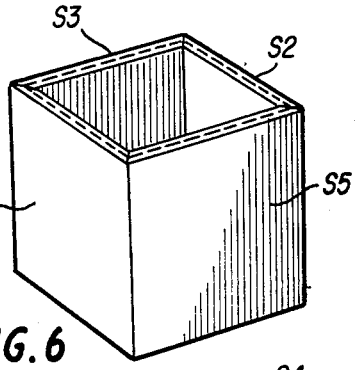
FIG. 6
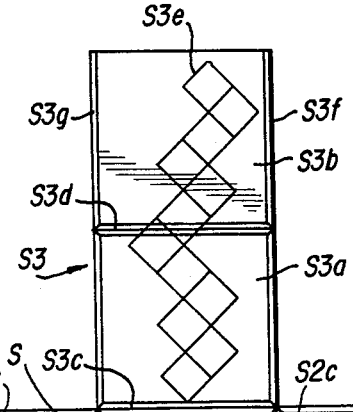
FIG. 5
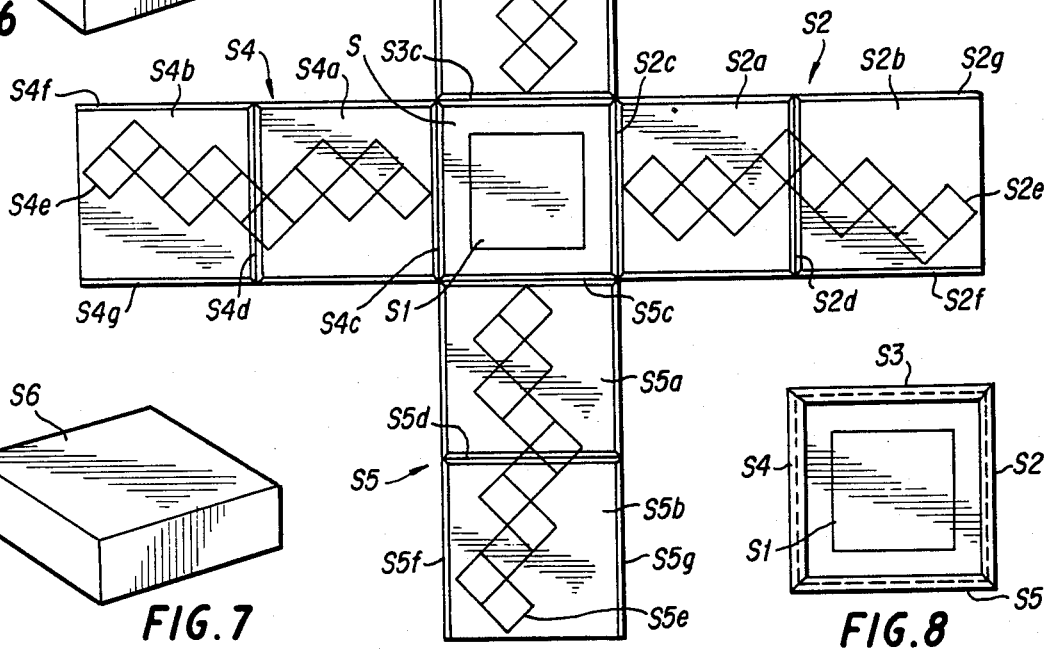
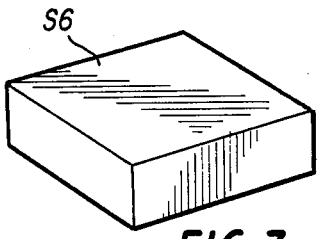
FIG. 7
FIG. 8

BOARD GAME HAVING CONSISTENT SHAPE RELATIONSHIP AMONG ITS PARTS

FIELD OF THE INVENTION

The present invention is a game concept for a specific number of players. More particularly, it is a game concept in which the game board is based upon geometrical figures which in turn determine the number of players.

BACKGROUND OF THE INVENTION

Game boards or grames in which a number of players participate and which employ some sort of means for advancing individual pieces belonging to each player along a set path toward a given goal are well known. Most game boards are designed around a rectangular central portion upon which there may be attached legs or path packages for a certain number of players. The Board may also be of a rectangular nature in which there is imprinted a center section or the goal from which radiate various path packages. The pieces played by each player are moved along their respective paths in accordance with various movement determinants such as dice, spinners, cards, and the like.

Most games of the nature described above generally fold in half and then are placed in a box into which are placed the various playing pieces, the determinants for advancement of the playing pieces, and other paraphernalia which may be a part of the particular game. The box is then provided with a cover which generally serves no other purpose than to just cover the box.

SUMMARY OF THE INVENTION

The present invention is a game concept based upon the use of known plane geometrical figures which serve as the base of the game board and from the sides of which are extendable playing surfaces with torturous paths thereon. The center piece or goal of the game board is of the same configuration as the geometrical shape upon which the game is built. The torturous paths upon each of the extendable playing portions are composed again of the same geometrical figure as the center of the game board and the plurality of these figures are arranged in these paths are commensurate with natural geometrical attachments. The present concept utilizes a pair of dice having surfaces again matching the geometrical configuration of the center area of the board and the playing paths. One die controls the number of spaces or figures along which the playing piece may be advanced and also contains two surfaces which may both be advantageous to the player or one may be advantageous and the other may be disadvantageous. The other die contains surfaces of the geometrical configuration of the central portion of the board and are colored in accordance with the colors on the various extendable playing surfaces. The second die will also contain two surfaces which can assist in the advance of the player's piece of cause the player to move his piece backward. Or it may conceivably give the player two forward movements or two backward movements.

BRIEF DESCRIPTION OF THE DRAWINGS

FIG. 1 is a plan view of a game board according to the present invention utilizing a triangle as the base.

FIG. 2 is a perspective of the embodiment in FIG. 1 when it is folded upon itself for storage.

FIG. 3 is a plan view of the embodiment of FIG. 1 when folded for storage.

FIG. 4 is a perspective of the cover which is placed over the game board as shown in FIG. 3 at storage time.

FIG. 5 is a plan view of the game board according to the present invention utilizing a square as the base.

FIG. 6 is a perspective of the embodiment of FIG. 5 when folded for storage.

FIG. 7 is a perspective of the cover for the embodiment shown in FIG. 5 when in storage position.

FIG. 8 is a plan view of the embodiment of FIG. 5 when folded for storage.

Figure 9:
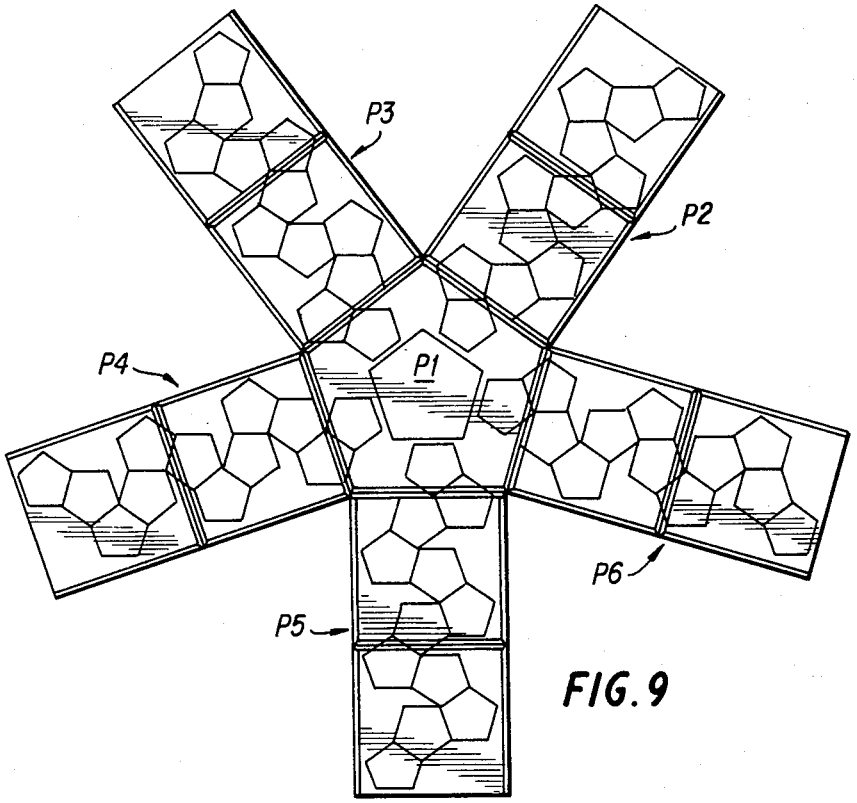
FIG. 9 is a plan view of the present invention utilizing a pentagon as the base.
Figure 10:
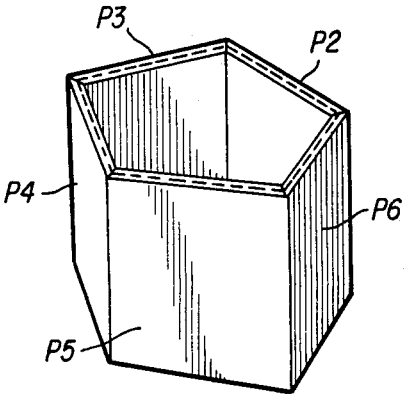
FIG. 10 is a perspective view of the embodiment shown in FIG. 9 when folded for storage.
Figure 11:
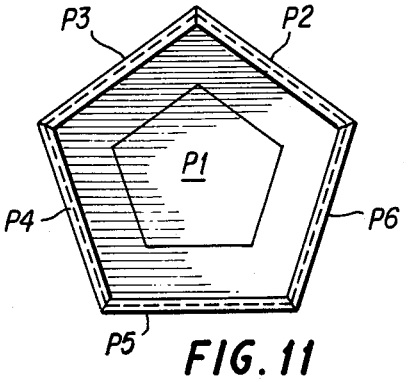
FIG. 11 is a plan view of the embodiment shown in FIG. 9 when folded for storage.
Figure 12:
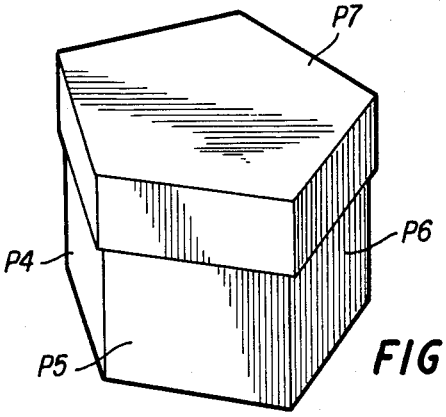
FIG. 12 is a perspective view showing the embodiment in FIG. 10 with a cover in place on it.

The embodiment seen in FIG. 1 comprises a triangular base portion, from each side of which extends a playing surface, T2, T3 and T4. Each of the playing surfaces contains at least two portions T2a, T2B, T3a, and T3b and T4a or T4b. Each playing surface is hinged to the base T and each along lines T2c, T3c, and T4c. Each of the two foldable sections of each playing surface are hingedly joined along hinge lines T2d, T3d, and T4d. Each playing surface contains a plurality of the geometrical figure of the base part indicated here as T2c, T3c, and T4c. Each of the playing surfaces T2, T3, and T4 have beveled edges. T2f and T2g, T3f, T3g, T4f, and T4g which are the beveled surfaces and which mate when the boards are folded up. The actual playing path on each playing surface consists of a plurality of the geometrical figures of the base portion which are joined along varying sides to produce the torturous path. The torturous paths shown in FIG. 1 are by way of illustration only and are not considered limiting.

FIGS. 2 and 3 are considered to be readily self-evident. The cover T5 shown in FIG. 4 is of the same configuration as the base of the particular board, and is used not only for a cover for the game when folded for storage as shown in FIGS. 2 and 3, but also serves as a cup to hold the pair of dice used.

FIGS. 5 through 8 show the embodiment based upon use of a square as the base of the game board. The description of the various parts of the embodiment shown in these figures is identical to that previously described as respective FIGS. 1 through 4 and the same letter designations have been utilized to indicate this indentity.

The embodiments shown in FIGS. 8 through 11 utilize a pentagon as the base of the game board. Other than the shape of the base and the associated portions, the details of the playing board are substantially identical as those previously described with respect to FIGS. 1 through 4, consideration being given to the difference in the shape of the geometrical form used as the base. The similar features have been identified with substantially identical reference numerals as in FIG. 1 to show the conformity of this embodiment with the initial concept.

Figure 13A:
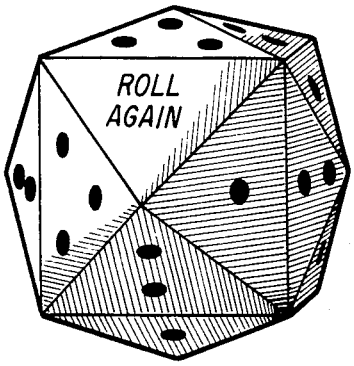
FIG. 13A is a perspective view of one of the die for use with the embodiment shown in FIG. 1.
Figure 13B:
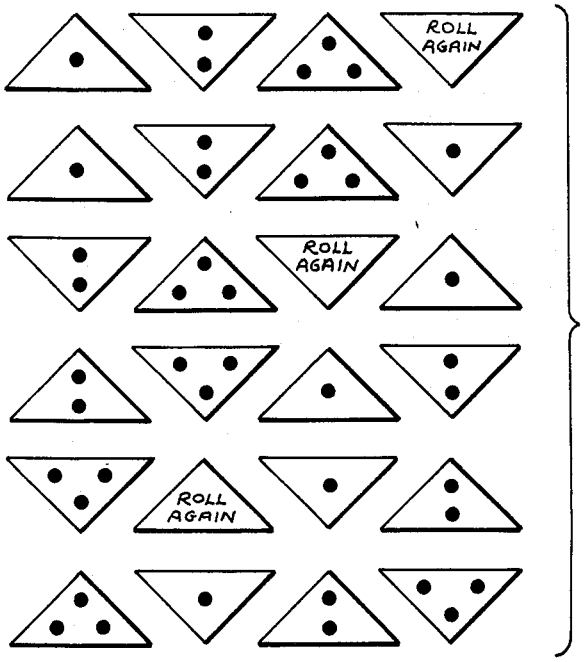
FIG. 13B shows the various faces of the die shown in FIG. 13A.

It will be seen that the die in FIG. 13 is a polyhedron known as a tetra-hexa hedron, having a total of 24 facets. It is composed of 24 equilateral, triangular facets, each of which is flat so that the die can rest on any facet. Because of the large number of facets on this die, it will be observed in FIG. 1 again that the path for advancement of the play pieces has a greater number of spaces actually to be covered. For this reason each major triangular space on the playing board is divided into three triangular spaces. The path of movement of the playing piece on the playing board shown in FIG. 1. It's shown by a circuitous line PP which leads from the beginning playing space into the center T-1. Because of the increased number of spaces which actually must be covered, the player is afforded an opportunity for three roll-again possibilities as contrasted with two in some of the other die.

Figure 14B:
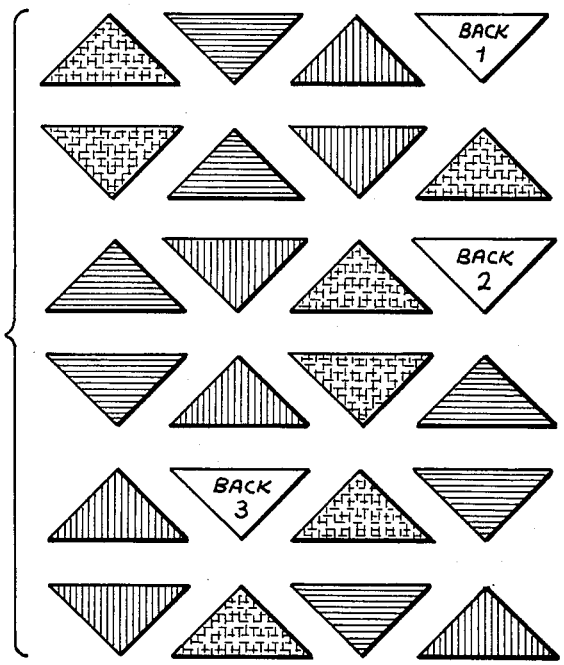
FIG. 14B shows the various faces of the die shown in FIG. 14A.
Figure 14A:
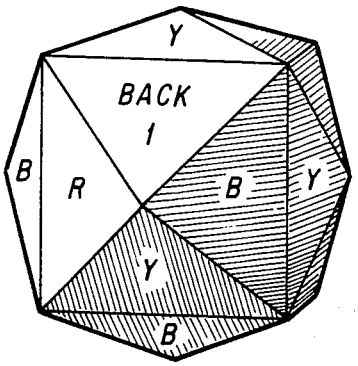
FIG. 14A is a view of the other of the die for use with the embodiment shown in FIG. 1.

Referring now to FIG. 14, it will be seen that there are a greater number of opportunities for a player's color to come up, as well as for his opponent's. Again, because of the greater number of facets the possible advantageous movement has increased enough so the number of penalty spaces have been increased to three as shown in FIG. 14.

Figure 15A:
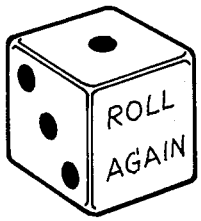
FIG. 15A is a perspective view of one of the die for use with the embodiment shown in FIG. 5.
Figure 15B:
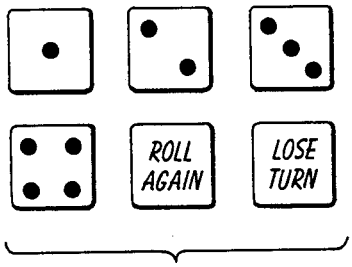
FIG. 15B shows the various faces of the die shown in FIG. 15A.

Turning now to FIG. 15 we see the die shown therein will seem to be that of a cube having six faces. The embodiment utilizing the square as the base for this embodiment obviously makes the game a bit different than what the other multi-surfaced die, but perhaps adds a little bit more zest to the game since the opportunities for movement are different.

As it will be seen, the die has four of the faces of the conventional die markings 1 through 4. The other two surfaces of the die indicated disclose an opportunity for the player to roll the dice again and on the other side for him to lose his next turn. The die could have the same instructions on both sides.

Figure 16A:
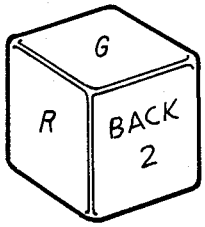
FIG. 16A is a perspective view of the other of the die for use with the embodiment shown in FIG. 5.
Figure 16B:
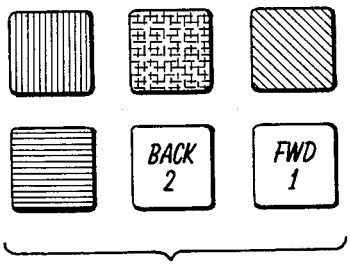
FIG. 16B shows the various faces of the die shown in FIG. 16A.

FIG. 16 shows the other die employed with the embodiment in FIGS. 5 through 8. It will be seen herein that the four faces of the die have colors indicated merely by way of illustration and in no way restricts the present invention. The other two faces of the die indicate that the player is to move back two spaces or to move forward one space. Again both of the uncolored surfaces of the die could contain the same instructions, be it backward or forward.

Figure 17A:
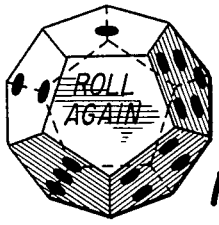
FIG. 17A is a view of one of the die for use with the embodiment shown in FIG. 9.
Figure 17B:
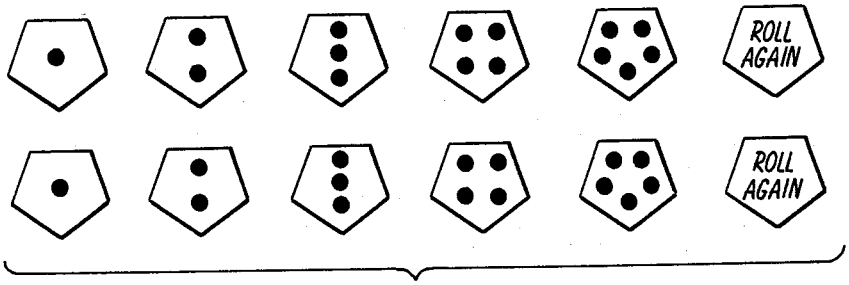
FIG. 17B shows the various faces of the die shown in FIG. 17A.

Turning now to FIG. 17, it is seen that the die shown in this figure for use with the embodiment shown in FIGS. 9 through 12 has 12 faces. Ten of the faces display numbers while the other faces reward the player.

Figure 18A:
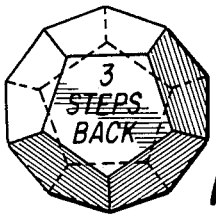
FIG. 18A is a view of the other of the die for use with the embodiment shown in FIG. 9.
Figure 18B:
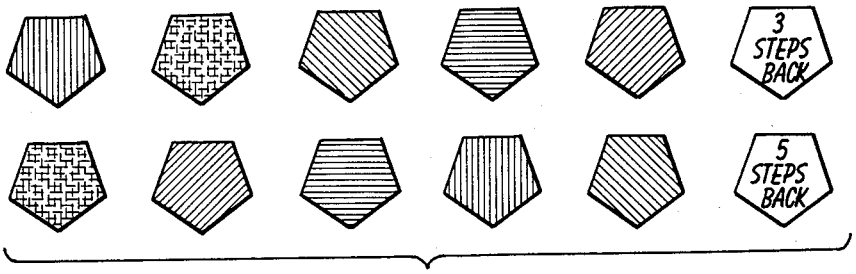
FIG. 18B shows the various faces of the die shown in FIG. 18A.

Continuing now to FIG. 18, we see again the other die to be used with the embodiment shown in FIGS. 9 through 12 also contains 12 faces, ten of which are colored or are indicated as shown by way of illustration, and two faces which contain markings impeding the progress of the player.

For clarity and simplicity of playing, it should be pointed out that each of the playing surfaces for the various embodiments shown herein will be of a different color. The torturous paths composed of the geometrical figures identical to the base of the gameboard would preferably be white again so that the colors of the playing pieces would be the same geometrical shape as the base and could be solid or could be annular.

RULES FOR PLAY

As is evident, the concept of the invention is for a specific number of players called for by the base shape or conceivably teams that consist of two or more players. For simplicity sake in describing the play of the game, it will be assumed that there is a single player for each of the playing surfaces, i.e., three players for the embodiment in FIG. 1, four players for the embodiment in FIG. 4, and five players for the embodiment in FIG. 8.

Each player selects a color. Each player in turn then rolls the dice for his particular game board and the one scoring the highest number will start play. Both dice are then placed in the respective cover and tossed. If the color die turns a color other than the color selected by the thrower, the player having that color then begins to advance his playing pieces along his particular torturous path and he moves the distance indicated by the numerical dice. The next player, be it right or left as has been previously determined, then takes the dice and begins to throw it. The player in turn then tosses the dice for movement or as indicated by the penalty dice they play and they lose a turn. It should be pointed out that the basic object of each player is to get all his playing pieces into the aforementioned center of the game board. In this connection the game would continue a course of play indicated by the roll of the dice. When a penalty and color show, the player having that particular color then must accept that penalty.

Application of this principle adds interest in the game in that a player may handicap his competitors merely by his own throws without advancing himself.

For added interest in the game, play money is provided. The money is utilized to build up a pot which is based upon the penalties which arise during the course of the game, the player who first advanced all his playing pieces into the base portion of the board takes the pot. Each playing piece must have the exact number to move into the base portion of the playing board. It may continue with other players until all but one have placed their playing pieces in the base portion of the playing board.

It should be pointed out that when the game board is folded for storage the dice and the playing pieces and play money are placed within the folded up game board and the cover placed thereon which keeps the game intact.

While the concept of the present invention has been shown with only three geometrical figures, it is evident to one of skill in the art that a more complex and complicated game can be prepared by utilizing additional multi-sided geometrical figures with appropriate multsided dice.

What is claimed is:

1. A game comprising a playing board, playing pieces, a pair of dice, and a cover for the board, wherein: the playing board comprises a central section having a plane geometrical shape, an elongated rectangular planar playing surface extending outwardly from each side of said geometrical central section, each playing surface having a plurality of playing spaces arranged on said playing surface in a single torturous path extending from the distal edge of the playing surface radially to the central section which constitutes a goal, said playing spaces having the same geometrical shape as the central section and being uncolored, each playing surface being of a different color; said playing pieces being identical in shape to the shape of the geometrical central section, said dice comprising a pair of polyhedrons, each polyhedron having a plurality of facets of the identical geometrical shape as the central section, one die having indicia on each facet to indicate the number of playing spaces a playing piece may be moved, the indicia being in the range of from one to the number of sides of the geometrical shape of the central section of the playing board and at least two facets having instructions for rolling the dice, the other die having the same number of facets as the one die, each facet being one of the colors of the playing surfaces, at least two of the facets having instructions penalizing the player; said cover comprising a solid geometrical form identical to the geometrical shape of the central section and open on one side in order to serve as a cup for throwing said dice.

2. The game according to claim 1, wherein planar surface is composed of at least two hingedly joined portions adapted such that to one is folded over the other, one end of each of said playing surfaces being hingedly joined to its respective side of said base portion, said plane surfaces when folded upon each other and a respective edge of the base portion form a box which in combination with said cover, provides a container for storing the said dice and playing pieces.

3. A game according to claim 1 wherein said base portion is a triangle, said plane spacers are triangles subdivided into three triangles and said dice are tetrahexahedrons.

4. A game according to claim 3 wherein in said pair of dice one of said dice has 21 facets broken up into seven groups of three and three other facets giving throwing instructions to the player; the other in said pair of dice having the 21 facets divided into seven groups of three, the facets in each group having a different color, and three other facets giving penalizing instructions to the player.

5. A game according to claim 1 wherein said base portion is a square, said playing spaces are squares, and said dice are cubes.

6. A game according to claim 5 wherein in said pair of dice one of said dice has four facets bearing numbers from one to four and two facets bearing throwing instructions to the players; the other of said pair of dice having a different color on each of four facets and two facets bearing penalizing instructions to the player.

7. A game according to claim 1 wherein said base portion is a pentagon, said playing spaces are pentagonal, and said dice are dodecohedrons.

8. A game according to claim 7 wherein in said pair of dice said facets on one die are arranged in two groups of five, the facets in each group bearing the numbers one through five, and two facets bearing throwing instructions to the players; the other die in said pair having the facets arranged in two groups of five, the facets in each group being of different colors, the colors of the two groups being identical, and two facets bearing penalizing instructions to the player.

9. A game comprising a playing board; playing pieces, a pair of dice, and a cover for the board wherein: the playing board comprises a base portion having the shape of a pentagon, an elongated, rectangular playing surface hingedly joined to and and extending outwardly from each side of said pentagonal base portion, each said playing surface being adapted to be moved to an upstanding position perpendicular to the base portion to form the sides of a pentagonal box, each playing surface having a plurality of pentagonal playing spaces arranged on said playing surface in a single torturous path extending from the distal edge of the playing surface radially to the base portion which forms a goal, each playing surface being of a different color, the playing spaces being uncolored; said playing pieces comprising five groups of pentagonal shapes, each group being of the color of the playing surface with which it is to be associated during play, said dice comprising a pair of regular dodecahedrons, each die having two groups of six pentagonal facets, one die having five of the facets in each group bearing the numbers one through five to indicate the number of playing spaces a playing piece may be moved and the remaining facet in each group having instructions for rolling the dice, the other die having each of five facets of one of the colors of the playing surfaces to indicate which playing pieces may be moved according to the roll of the one die, the sixth facet in each group having an instruction penalizing the player who rolled said die; said cover comprising a hollow pentagonal box closed on one end and open on the opposing end to be fitted over the upstanding playsurfaces when play is completed, the cover serving as a cup for throwing the dice during play.

10. The game according to claim 9 wherein each playing surface is comprised of at least two hingedly joined portions, an outer one and an inner one the outer one being adapted to be folded over the inner one, said playing surfaces when folded over each other and then formed into said box which in combination with said cover provides a container for storing said dice and playing pieces after play.

* * * * *